US007687445B2

(12) United States Patent
Rosenbaum et al.

(10) Patent No.: US 7,687,445 B2
(45) Date of Patent: Mar. 30, 2010

(54) LOWER ASH LUBRICATING OIL WITH LOW COLD CRANKING SIMULATOR VISCOSITY

(75) Inventors: John M. Rosenbaum, Richmond, CA (US); Nancy K. Smrcka, Richmond, CA (US)

(73) Assignee: Chevron U.S.A. Inc., San Ramon, CA (US)

( * ) Notice: Subject to any disclaimer, the term of this patent is extended or adjusted under 35 U.S.C. 154(b) by 1010 days.

(21) Appl. No.: 11/159,282

(22) Filed: Jun. 22, 2005

(65) Prior Publication Data

US 2006/0293193 A1 Dec. 28, 2006

(51) Int. Cl.
*C10M 145/00* (2006.01)

(52) U.S. Cl. ..... 508/591

(58) Field of Classification Search ..... 508/591
See application file for complete search history.

(56) References Cited

U.S. PATENT DOCUMENTS

| | | | | |
|---|---|---|---|---|
| 6,503,872 | B1 * | 1/2003 | Tomaro | 508/377 |
| 7,374,653 | B2 | 4/2005 | Rosenbaum et al. | |
| 2002/0019320 | A1 * | 2/2002 | Nakazato et al. | 508/159 |
| 2004/0118744 | A1 * | 6/2004 | Daniel et al. | 208/18 |
| 2004/0154958 | A1 * | 8/2004 | Alexander et al. | 208/18 |

FOREIGN PATENT DOCUMENTS

| | | | |
|---|---|---|---|
| WO | WO02064710 | A2 * | 8/2002 |
| WO | WO 2004/033606 | | 4/2004 |
| WO | WO 2004/053030 | | 6/2004 |

OTHER PUBLICATIONS

U.S. Appl. No. 10/743,932, filed Dec. 23, 2003, Chevron U.S.A. Inc.
U.S. Appl. No. 10/949,779, filed Sep. 23, 2004, Chevron U.S.A. Inc.

* cited by examiner

*Primary Examiner*—Glenn A Caldarola
*Assistant Examiner*—Taiwo Oladapo
(74) *Attorney, Agent, or Firm*—Susan M. Abernathy

(57) ABSTRACT

A lubricating oil comprising: a) at least 5 wt % of lubricating base oil, made from a waxy feed, having >10 wt % molecules with cycloparaffinic functionality, a ratio of molecules with monocycloparaffinic functionality to molecules with multi-cycloparaffinic functionality >20, and b) a DI additive package; wherein the lubricating oil contains <0.2 wt % VI improver and wherein the lubricating oil has a low sulfated ash and a low CCS viscosity at −20° C. A lubricating oil with a kinematic viscosity at 100° C. between 12.5 and 16.3 cSt with a low CCS viscosity comprising: a) a lubricating base oil, made with a waxy feed, having a viscosity index >150, b) up to 75 wt % unconventional petroleum derived bright stock, c) a lower ash DI additive package, and d) <0.2 wt % viscosity index improver. A process to make lubricating oil with a low sulfated ash and low CCS viscosity.

26 Claims, No Drawings

LOWER ASH LUBRICATING OIL WITH LOW COLD CRANKING SIMULATOR VISCOSITY

FIELD OF THE INVENTION

This invention is directed to a composition of lower ash lubricating oil with low cold cranking simulator viscosity, preferred for use in natural gas engines.

BACKGROUND

U.S. patent application Ser. No. 10/743,932, filed Dec. 23, 2003, teaches a finished lubricant that has less than 8 weight percent VI improver made having a lubricating base oil made from Fischer Tropsch wax having particularly desired aromatic and cycloparaffinic molecular composition and at least one lubricant additive. This application, however, does not teach a lower ash lubricating oil containing no viscosity index improver that has a low cold cranking simulator viscosity.

U.S. patent application Ser. No. 10/949,779, filed Sep. 23, 2004, teaches a multigrade engine oil comprising: (a) a Fischer-Tropsch base oil characterized by a kinematic viscosity between about 2.5 and about 8 cSt at 100° C., and having a desired composition of cycloparaffin molecules; (b) a pour point depressing base oil blending component; and (c) an additive package designed to meet the specifications for ILSAC GF-3; and (d) no additional pour point depressant additive or viscosity index improver. Nothing is taught about blending lower ash lubricating oil suitable for use in a natural gas engine without any viscosity index improver and having a low cold cranking simulator viscosity.

PCT Applications WO 2004/053030 and PCT Application WO2004/033606 teach finished lubricants made using base oils made from Fischer-Tropsch wax that have high viscosity indexes and low cold cranking simulator viscosities. Nothing is taught about blending lower ash lubricating oils suitable for use in natural gas engines without any viscosity index improver.

Lower ash lubricating oil suitable for use in natural gas engines with improved cold crank properties over current SAE 40 oils is desired. In addition, customers want lower ash lubricating oils with better low temperature properties meeting SAE 15W-40 specifications. Most current natural gas engine oils (NGEO) meeting SAE 15W-40 specifications, for example, require the addition of viscosity index improvers that may shear in use. In addition, some natural gas original equipment manufacturers (OEMs) require that no conventional petroleum derived bright stock be used in the natural gas engine oil, so blends with good viscometric properties without conventional petroleum derived bright stock are preferred.

SUMMARY OF THE INVENTION

We have invented a lubricating oil comprising: a) at least 5 wt % of lubricating base oil, made from a waxy feed, having: greater than 10 wt % molecules with cycloparaffinic functionality, a ratio of molecules with monocycloparaffinic functionality to molecules with multicycloparaffinic functionality greater than 20; and b) a DI additive package; wherein the lubricating oil contains less than 0.2 wt % viscosity index improver which is a homo- or co-polymer or derivative thereof of number average molecular weight of about 15000 to 1 million atomic mass units; and wherein the lubricating oil has a sulfated ash by ASTM D 874-00 of 1.0 weight percent or less, and a cold cranking simulator viscosity at −20° C. less than 9000 cP.

In another embodiment, we have invented a lubricating oil, comprising: a) between 5 and 95 wt % lubricating base oil made from a waxy feed, wherein the lubricating base oil made from a waxy feed has a viscosity index greater than 150; b) up to 75 wt % unconventional petroleum derived bright stock having a viscosity index greater than 120; c) between 5 and 12 wt % lower ash DI additive package; and d) less than 0.2 wt % viscosity index improver which is a homo- or co-polymer or derivative thereof of number average molecular weight of about 15000 to 1 million atomic mass units; wherein the lubricating oil has a kinematic viscosity at 100° C. between 12.5 and 16.3 cSt and a cold cranking simulator viscosity at −20° C. less than 8000 cP.

Additionally, we have invented a process to make a lubricating oil, comprising: a) selecting a lubricating base oil, made from a waxy feed, having greater than 10 wt % molecules with cycloparaffinic functionality, a ratio of molecules with monocycloparaffinic functionality to molecules with multicycloparaffinic functionality greater than 20; and b) blending the lubricating base oil with a lower ash DI additive package and less than 0.2 wt % viscosity index improver which is a homo- or co-polymer or derivative thereof of number average molecular weight of about 15000 to 1 million atomic mass units; wherein the lubricating oil has a sulfated ash by ASTM D 874-00 of 1.0 weight percent or less and a cold cranking simulator viscosity at −20° C. less than 9000 cP.

DETAILED DESCRIPTION

We have invented lower ash SAE 15W-40 lubricating oils (1.0 to 0.0% ash) with very low levels of VI (or even without VI improver), and also either without conventional petroleum derived bright stock or with unconventional bright stock having a viscosity index greater than 120, that gives better cold crank properties than current low ash SAE 40 lubricating oils. These new lubricating oils provide excellent low temperature properties and low exhaust emissions, which are especially needed in remote gas field applications and selected alternate fueled vehicles running on compressed natural gas. In addition the shear stabilities are excellent due to their not having any viscosity index improver added to them.

Natural gas engine oils typically have DI additive packages that give good oxidation and nitration performance and the viscosity of the oil remains constant over the life of the oil. For end users who need improved low temperature performance in remote locations in the past they have had to blend oils with viscosity improver. The viscosity improver would break down (shear down) and the viscosity of the oil would drop below the engine builders' recommendation limit. This would cause increased wear and maintenance. The invention gives improved low temperature performance without the drop in viscosity or increased wear.

The lubricating oils of this invention require very little or no viscosity index improver. This is due to the very high viscosity and excellent low temperature properties of the lubricating base oils made from a waxy feed that are used in their formulation. The elimination of viscosity index improver reduces the overall cost of the formulated product, improves the cold cranking simulator viscosity, improves the shear stability of the lubricating oil and gives lower wear and maintenance. Earlier formulators of lower ash lubricating oils did not appreciate the improvements that could be obtained when a lubricating base oil with more desired cycloparaffin composition is used.

Natural gas engine manufacturers have placed a major emphasis on reducing exhaust (NOx) emissions from their equipment. They have done this by requiring the use of emission catalysts, and natural gas lubricating oils that are lower ash. Lower ash in the context of this disclosure means 1.0 to 0.0 wt % sulfated ash. Sulfated ash is determined by ASTM D 874-00. Natural gas engine oils that have greater than 1.0 wt % sulfated ash may be incompatible with the emission catalysts used in modern natural gas engines. Natural gas engine oils that are above this sulfated ash range may also cause excessive combustion chamber deposits, pre-ignition, detonation, spark plug fouling, cylinder head deposits, and port deposits.

There are two principal categories of lubricating oil additives used in this invention: DI additive packages (Detergent Inhibitor additive packages) and VI improvers (Viscosity Index improvers). DI additive packages serve to suspend oil contaminants and combustion by-products as well as to prevent oxidation of the oil with the resultant formation of varnish and sludge deposits. VI improvers modify the viscometric characteristics of lubricants by reducing the rate of thinning with increasing temperature and the rate of thickening with low temperatures. VI improvers thereby provide enhanced performance at low and high temperatures. In many multigrade engine oil applications VI improvers have to be used with DI additive packages. DI additive packages are available from additive suppliers. Additive packages are formulated such that, when they are blended with a lubricating base oil or base oil blend having the desired properties, the resulting engine oil is likely to meet the OEM requirements.

DI Additive Package:

DI additive packages typically contain dispersants, detergents, wear inhibitors, and oxidation inhibitors. Other components can be included. The DI additive packages useful in this invention are lower ash. When blended into an engine oil, lower ash DI engine oil additive packages provide for a lower ash lubricating oil with a sulfated ash between about 0.0 and 1.0 wt % sulfated ash. Sulfated ash is determined by ASTM D 874-00. So called "ashless" DI additive packages provide for an "ashless" lubricating oil that contains less than 0.15 wt % sulfated ash. Examples of DI additive packages providing for less than 0.15 wt % sulfated ash in the lubricating oil that are useful in this invention are described in U.S. Pat. No. 6,001,780, and incorporated herein. Examples of other lower ash DI additive packages useful in this invention are described in U.S. Pat. Nos. 5,726,133 and 6,756,348, and incorporated herein.

When incorporated in lubricating oil, the lower ash DI additive package provides enhanced oxidation inhibition, nitration inhibition, total base retention, reduction in acid formation and reduction in percent viscosity increase of the lubricating oil. The lower ash DI additive package is used in an amount between 5 and 12 wt % in the lubricating oil, preferably in an amount between 6 and 10 wt %.

One embodiment of the DI additive package of this invention may comprise of one or more dispersants, one or more detergents, one or more wear inhibitors and one or more oxidation inhibitors described herein.

The lubricating oil of this invention may comprise a DI additive package that provides the lubricating oil with about 1 wt. % to about 8 wt. % of one or more dispersants, about 1 wt. % to about 8.5 wt. % of one or more detergents, about 0.2 wt. % to about 1.5 wt. % of one or more wear inhibitors and about 0.2 wt. % to about 3 wt. % of one or more oxidation inhibitors described herein. The DI additive package of this invention may also comprise other additives traditionally used in the lubricating oil industry.

Another embodiment of a lubricating oil of this invention may comprise a DI additive package that provides the lubricating oil with about 1.25 wt. % to about 6 wt. % of one or more dispersants, about 2 wt. % to about 6 wt. % of one or more detergents, about 0.3 wt. % to about 0.8 wt. % of one or more wear inhibitors and about 0.6 wt. % to about 2.5 wt. % of one or more oxidation inhibitors described herein. These components make up one embodiment of the DI additive package of this invention. The DI additive package of this invention may also comprise other additives traditionally used in the lubricating oil industry.

The DI additive package of this invention may comprise diluent oil. It is known in the art to add diluent oil to additive formulations and this is called "trimming" the additive formulation. A preferred embodiment may be trimmed with any diluent oil typically used in the industry. This diluent oil may be a Group I or above oil. A preferred amount of diluent oil may comprise about 4.00 wt %.

A. Detergent

Any detergents commonly used in lubricating oils may be used in this invention. These detergents may or may not be overbased detergents or they may be low, neutral, medium, or high overbased detergents. For example, detergents of this invention may comprise sulfonates, salicylates and phenates. Metal sulfonates, salicylates and phenates are preferred. When the term metal is used with respect to sulfonates, salicylates and phenates herein, it refers to calcium, magnesium, lithium, magnesium, potassium and barium.

The detergent may be incorporated into the lubricating oil of this invention in an amount of about 1.0 wt. % to about 8.5 wt. %, preferably from about 2 wt. % to about 6 wt. %.

B. Dispersant

A preferred embodiment of the lubricating oil of this invention may comprise one or more nitrogen containing ashless dispersants of the type generally represented by succinimides (e.g., polyisobutylene succinic acid/anhydride (PIBSA)-polyamine having a PIBSA molecular weight of about 700 to 2500). The dispersants may or may not be borated or non-borated. The dispersant may be incorporated into the lubricating oil of this invention in an amount of about 1 wt. % to about 8 wt. %, more preferably in the amount of about 1.5 wt. % to about 6 wt %. Preferred dispersants for this invention comprise one or more ashless dispersants having an average molecular weight (mw) of about 1000 to about 5000. Dispersants prepared from polyisobutylene (PIB) having a molecular weight of about 1000 to about 5000 are such preferred dispersants.

A preferred dispersant of this invention may be one or more succinimides. The term "succinimide" is understood in the art to include many of the amide, imide, etc. species that are also formed by the reaction of a succinic anhydride with an amine and is so used herein. The predominant product, however, is succinimide and this term has been generally accepted as meaning the product of a reaction of an alkenyl- or alkyl-substituted succinic acid or anhydride with a polyamine. Alkenyl or alkyl succinimides are disclosed in numerous references and are well known in the art. Certain fundamental types of succinimides and related materials encompassed by the term of art "succinimide" are taught in U.S. Pat. Nos. 2,992,708; 3,018,250; 3,018,291; 3,024,237; 3,100,673; 3,172,892; 3,219,666; 3,272,746; 3,361,673; 3,381,022; 3,912,764; 4,234,435; 4,612,132; 4,747,965; 5,112,507; 5,241,003; 5,266,186; 5,286,799; 5,319,030; 5,334,321; 5,356,552; 5,716,912, the disclosures of which are hereby incorporated by reference.

This invention may comprise one or more succinimides, which may be either a mono or bis-succinimide. This invention may comprise a lubricating oil involving one or more succinimide dispersants that have or have not been post treated.

C. Wear Inhibitor

Wear inhibitors such as metal dithiophosphates (e.g., zinc dialkyl dithiophosphate, ZDDP), metal dithiocarbamates, metal xanthates or tricresylphosphates may be included. Wear inhibitors may be present in the amount of about 0.24 wt. % to 1.5 wt. %, more preferably in the amount of about 0.3 wt. % to about 0.80 wt. %, most preferably in the amount of about 0.35 wt. % to about 0.75 wt. % of the lubricating oil. A preferred wear inhibitor is zinc dithiophosphate. Other wear inhibitors that may be included are zinc dialkyldithiophosphate and/or zinc diaryldithiophosphate (ZnDTP). The wear inhibitor may be incorporated into the lubricating oil of this invention in an amount of about 0.2 wt. % to 1.5 wt. %, more preferably in the amount of about 0.3 wt. % to about 0.8 wt. % of the lubricating oil. These values may include a small amount of hydrocarbon oil that was used in preparing zinc dithiophosphate. Preferred ranges of phosphorus in the finished lubricating oil are about 0.01 wt. % to about 0.11 wt. %, more preferably about 0.02 wt. % to about 0.07 wt. %.

The alkyl group in the zinc dialkyldithiophosphate may be, for example, a straight or branched primary, secondary or tertiary alkyl group of about 2 to about 18 carbon atoms. Examples of the alkyl groups include ethyl, propyl, iso-propyl, butyl, pentyl, hexyl, heptyl, octyl, decyl, dodecyl, and octadecyl. The alkylaryl group of the zinc dialkylaryldithiophosphate is, for example, a phenyl group having an alkyl group of about 2 to about 18 carbon atoms, such as butylphenyl group, nonylphenyl group, and dodecylphenyl group.

D. Oxidation Inhibitor

Oxidation inhibitors may be present in the lower ash DI additive package to minimize and delay the onset of lubricant oxidative degradation. In a preferred embodiment the DI additive package of this invention may comprise one or more hindered phenol oxidation inhibitors. Examples of hindered phenol (phenolic) oxidation inhibitors include: 4,4'-methylene-bis(2,6-di-tert-butylphenol), 4,4'-bis(2,6-di-tert-butylphenol), 4,4'-bis(2-methyl-6-tert-butylphenol), 2,2'-methylene-bis(4-methyl-6-tert-butylphenol), 4,4'-butylidene-bis (3-methyl-6-tert-butylphenol), 4,4'-isopropylidene-bis(2,6-di-tert-butylphenol), 2,2'-methylene-bis(4-methyl-6-nonylphenol), 2,2'-isobutylidene-bis(4,6-dimethylphenol), 2,2'-methylene-bis(4-methyl-6-cyclohexylphenol), 2,6-di-tert-butyl-4-methylphenol, 2,6-di-tert-butyl-4-ethylphenol, 2,4-dimethyl-6-tert-butyl-phenol, 2,6-di-tert-l-dimethylamino-p-cresol, 2,6-di-tert-4-(N,N'-dimethylaminomethylphenol), 4,4'-thiobis(2-methyl-6-tert-butylphenol), 2,2'-thiobis(4-methyl-6-tert-butylphenol), bis(3-methyl-4-hydroxy-5-tert-butylbenzyl)-sulfide, and bis(3,5-di-tert-butyl-4-hydroxybenzyl).

Another embodiment of the DI additive package comprises the oxidation inhibitor 2-(4-hydroxy-3,5-di-t-butyl benzyl thiol) acetate, which is available commercially from Ciba Specialty Chemicals at 540 White Plains Road, Terrytown, N.Y. 10591 as IRGANOX L118®, and no other oxidation inhibitor.

Additional or other types of oxidation inhibitors may be used. Additional oxidation inhibitors may further reduce the tendency of lubricating oils to deteriorate in service. The DI additive package may include but is not limited to contain such oxidation inhibitors as metal dithiocarbamate (e.g., zinc dithiocarbamate), methylenebis (dibutyldithiocarbamate), and diphenyl amine. Diphenylamine oxidation inhibitors include, but are not limited to, alkylated diphenylamine, phenyl-.alpha.-naphthylamine, and alkylated-.alpha.-naphthylamine. In some formulations a synergistic effect may be observed between different oxidation inhibitors, such as between alkylated diphenyl amines and hindered phenol oxidation inhibitors.

One or more oxidation inhibitors may be incorporated into the lubricating oil of this invention in an amount of about 0.05 wt. % to about 5 wt. %, preferably from about 0.2 wt. % to about 3 wt. %, more preferably from about 0.6 wt. % to about 2.5 wt. %.

Other Additive Components

The following other additive components are examples of some of the components that may be favorably employed in this invention. These examples of additives are provided to illustrate this invention, but they are not intended to limit it:

A. Wear Inhibitors

In addition to the wear inhibitors mentioned in the DI additive package section, other traditional wear inhibitors may be used. As their name implies, these agents reduce wear of moving metallic parts. Examples of such agents include, but are not limited to, phosphates, phosphites, carbamates, esters, sulfur containing compounds, and molybdenum complexes.

B. Rust Inhibitors (Anti-Rust Agents)

Applicable rust inhibitors include:

1. Nonionic polyoxyethylene surface active agents: polyoxyethylene lauryl ether, polyoxyethylene higher alcohol ether, polyoxyethylene nonyl phenyl ether, polyoxyethylene octyl phenyl ether, polyoxyethylene octyl stearyl ether, polyoxyethylene oleyl ether, polyoxyethylene sorbitol monostearate, polyoxyethylene sorbitol mono-oleate, and polyethylene glycol mono-oleate; and
2. Other compounds: stearic acid and other fatty acids, dicarboxylic acids, metal soaps, fatty acid amine salts, metal salts of heavy sulfonic acid, partial carboxylic acid ester of polyhydric alcohol, and phosphoric ester.

C. Demulsifiers

Demulsifiers that may be used include additional products of alkylphenol and ethylene oxide, polyoxyethylene alkyl ether, and polyoxyethylene sorbitan ester.

D. Extreme Pressure Agents (EP Agents)

EP Agents that may be used include Zinc dialkyldithiophosphate (primary alkyl, secondary alkyl, and aryl type), sulfurized oils, diphenyl sulfide, methyl trichlorostearate, chlorinated naphthalene, fluoroalkylpolysiloxane, and lead naphthenate.

E. Friction Modifiers

Fatty alcohol, fatty acid, amine, borated ester, and other esters.

F. Multifunctional Additives

Sulfurized oxymolybdenum dithiocarbamate, sulfurized oxymolybdenum organo phosphorodithioate, oxymolybdenum monoglyceride, oxymolybdenum diethylate amide, amine-molybdenum complex compound, and sulfur-containing molybdenum complex compound may be used.

G. Pour Point Depressants

Polymethyl methacrylate may be used.

H. Foam Inhibitors

Alkyl methacrylate polymers and dimethyl silicone polymers may be used.

Viscosity Index Improvers (VI Improvers)

Generally VI improvers are olefin homo- or co-polymers or derivative thereof of number average molecular weight of about 15000 to 1 million atomic mass units (amu), generally added to lubricating oils at concentrations from about 0.1 to 10 wt %. They function by thickening the lubricating oil to which they are added more at high temperatures than low, thus keeping the viscosity change of the lubricant with temperature more constant than would otherwise be the case. The change in viscosity with temperature is commonly represented by the viscosity index (VI), with the viscosity of oils with large VI (e.g. 140) changing less with temperature than the viscosity of oils with low VI (e.g. 90).

Major classes of VI improvers include: polymers and copolymers of methacrylate and acrylate esters; ethylene-propylene copolymers; styrene-diene copolymers; and polyisobutylene, VI improvers are often hydrogenated to remove residual olefin. VI improver derivatives include dispersant VI improver, which contain polar functionalities such as grafted succinimide groups.

The lubricating oil of the invention has less than 0.5 wt %, preferably less than 0.4 wt %, more preferably less than 0.2 wt % of VI improver. Most preferably the lubricating oil has no VI improver at all.

Base Oil

Three types of bright stocks are discussed in this disclosure: conventional petroleum derived bright stock, unconventional petroleum derived bright stock, and Fischer-Tropsch derived bright stock. Conventional petroleum derived bright stocks were found to cause port plugging in natural gas engines, and some natural gas engine manufacturers have specified that lubricating oils used in their engines may not contain conventional petroleum derived bright stock. Petroleum derived bright stocks (both conventional and unconventional) are named for the SUS viscosity at 210 degrees F., having viscosities above 180 cSt at 40 degrees C., preferably above 250 cSt at 40 degrees C., and more preferably ranging from 500 to 1100 cSt at 40 degrees C. Conventional petroleum derived bright stock has a viscosity index of 120 or less. Unconventional petroleum derived bright stock, such as bright stock derived from Daqing crude, has a viscosity index greater than 120. Fischer-Tropsch derived bright stock has a kinematic viscosity between about 15 cSt and about 40 cSt at 100 degrees C. and a viscosity index greater than 120, preferably greater than 145. It often will not have as high a viscosity at 40° C. as petroleum derived bright stock of similar viscosity at 100° C.

SAE J300 June 2001 contains the current specifications for SAE viscosity grades. The lubricating oils of this invention are preferably multigrade. Preferably they are one of SAE 15-XX, 20-XX, and 25-XX, where XX is selected from 40, 50, or 60. More preferably they are SAE 15W-40, or SAE 20W-40 viscosity grade; and most preferably they are SAE 15W-40 viscosity grade. A 15W-40 viscosity grade has a kinematic viscosity at 100° C. of at least 12.5 cSt and less than 16.3 cSt, and a maximum cold cranking simulator viscosity at −20° C. of 7,000 cP. A 20W-40 viscosity grade has a kinematic viscosity at 100° C. of at least 12.5 cSt and less than 16.3 cSt, and a maximum cold cranking simulator viscosity at −15° C. of 9,500 cP. A 25W-40 viscosity grade has a kinematic viscosity at 100° C. of at least 12.5 cSt and less than 16.3 cSt, and a maximum cold cranking simulator viscosity at −10° C. of 13,000 cP. In preferred embodiments the lubricating oils of this invention will meet the specifications for natural gas engine builders, including Cummins L10, M11; Detroit Diesel Series 50G, Waukesha, Caterpillar, Jenbacher, Deutz, Wartsila, Superior, MAN, Niigata, Perkins, Dorman, Guascor, Ulstein Bergen, and Dresser-Rand, Categories I II and III.

The lubricating oils of this invention may contain between 5 and 95 wt % of the base oil made from a waxy feed. In preferred embodiments the lubricating base oil made from a waxy feed has: less than 0.06 wt % aromatics, greater than 10 wt % molecules with cycloparaffin functionality, and a ratio of molecules with monocycloparaffin functionality to molecules with multicycloparaffinic functionality greater than 20.

Cold Cranking Simulator Viscosity:

The engine oils of this invention have a low cold cranking simulator viscosity. Cold cranking simulator viscosity is a test used to measure the viscometric properties of base oils and engine oils under low temperature and high shear. The test method to determine cold cranking simulator viscosity is ASTM D 5293-02. Results are reported in centipoise, cP. Cold cranking simulator viscosity has been found to correlate with low temperature engine cranking. Specifications for maximum cold cranking simulator viscosity are defined for engine oils by SAE J300, revised in June 2001. The cold cranking simulator viscosity measured at −20° C. of the engine oils of this invention are low, generally less than 9000 cP, preferably less than 7000 cP or 8000 cP, and more preferably less than 6000 cP.

Lubricating Base Oil Made from a Waxy Feed:

The lubricating base oils used in the lubricating oil of this invention are made from a waxy feed. The waxy feed useful in the practice of this invention will generally comprise at least 40 weight percent n-paraffins, preferably greater than 50 weight percent n-paraffins, and more preferably greater than 75 weight. percent n-paraffins. The weight percent n-paraffins is typically determined by gas chromatography, such as described in detail in U.S. patent application Ser. No. 10/897,906, filed Jul. 22, 2004, incorporated by reference. The waxy feed may be a conventional petroleum derived feed, such as, for example, slack wax, or it may be derived from a synthetic feed, such as, for example, a feed prepared from a Fischer-Tropsch synthesis. A major portion of the feed should boil above 650 degrees F. Preferably, at least 80 weight percent of the feed will boil above 650 degrees F., and most preferably at least 90 weight percent will boil above 650 degrees F. Highly paraffinic feeds used in carrying out the invention typically will have an initial pour point above 0 degrees C., more usually above 10 degrees C.

The term "Fischer-Tropsch derived" means that the product, fraction, or feed originates from or is produced at some stage by a Fischer-Tropsch process. The feedstock for the Fischer-Tropsch process may come from a wide variety of hydrocarbonaceous resources, including natural gas, coal, shale oil, petroleum, municipal waste, derivatives of these, and combinations thereof.

Slack wax can be obtained from conventional petroleum derived feedstocks by either hydrocracking or by solvent refining of the lube oil fraction. Typically, slack wax is recovered from solvent dewaxing feedstocks prepared by one of these processes. Hydrocracking is usually preferred because hydrocracking will also reduce the nitrogen content to a low value. With slack wax derived from solvent refined oils, deoiling may be used to reduce the nitrogen content. Hydrotreating of the slack wax can be used to lower the nitrogen and sulfur content. Slack waxes posses a very high viscosity index, normally in the range of from about 140 to 200, depending on the oil content and the starting material from which the slack wax was prepared. Therefore, slack waxes are suitable for the preparation of lubricating base oils having a very high viscosity index.

The waxy feed useful in this invention preferably has less than 25 ppm total combined nitrogen and sulfur. Nitrogen is measured by melting the waxy feed prior to oxidative combustion and chemiluminescence detection by ASTM D 4629-96. The test method is further described in U.S. Pat. No. 6,503,956, incorporated herein. Sulfur is measured by melting the waxy feed prior to ultraviolet fluorescence by ASTM D 5453-00. The test method is further described in U.S. Pat. No. 6,503,956, incorporated herein.

Waxy feeds useful in this invention are expected to be plentiful and relatively cost competitive in the near future as large-scale Fischer-Tropsch synthesis processes come into production. Syncrude prepared from the Fischer-Tropsch process comprises a mixture of various solid, liquid, and gaseous hydrocarbons. Those Fischer-Tropsch products which boil within the range of lubricating base oil contain a high proportion of wax which makes them ideal candidates for processing into lubricating base oil. Accordingly, Fischer-Tropsch wax represents an excellent feed for preparing high quality lubricating base oils according to the process of the invention. Fischer-Tropsch wax is normally solid at room temperature and, consequently, displays poor low temperature properties, such as pour point and cloud point. However, following hydroisomerization of the wax, Fischer-Tropsch derived lubricating base oils having excellent low temperature properties may be prepared. A general description of suitable hydroisomerization dewaxing processes may be found in U.S. Pat. Nos. 5,135,638 and 5,282,958; and U.S. patent application Ser. No. 10/744,870 filed December 23, incorporated herein.

The hydroisomerization is achieved by contacting the waxy feed with a hydroisomerization catalyst in an isomerization zone under hydroisomerizing conditions. The hydroisomerization catalyst preferably comprises a shape selective intermediate pore size molecular sieve, a noble metal hydrogenation component, and a refractory oxide support. The shape selective intermediate pore size molecular sieve is preferably selected from the group consisting of SAPO-11, SAPO-31, SAPO-41, SM-3, ZSM-22, ZSM-23, ZSM-35, ZSM-48, ZSM-57, SSZ-32, offretite, ferrierite, and combinations thereof. SAPO-11, SM-3, SSZ-32, ZSM-23, and combinations thereof are more preferred. Preferably the noble metal hydrogenation component is platinum, palladium, or combinations thereof.

The hydroisomerizing conditions depend on the waxy feed used, the hydroisomerization catalyst used, whether or not the catalyst is sulfided, the desired yield, and the desired properties of the lubricating base oil. Preferred hydroisomerizing conditions useful in the current invention include temperatures of 260 degrees C. to about 413 degrees C. (500 to about 775 degrees F.), a total pressure of 15 to 3000 psig, and a hydrogen to feed ratio from about 0.5 to 30 MSCF/bbl, preferably from about 1 to about 10 MSCF/bbl, more preferably from about 4 to about 8 MSCF/bbl. Generally, hydrogen will be separated from the product and recycled to the isomerization zone.

The hydroisomerization conditions are preferably tailored to produce one or more fractions having greater than 5 weight percent molecules with monocycloparaffinic functionality, more preferably having greater than 10 weight percent molecules with monocycloparaffinic functionality. The fractions will preferably have a ratio of molecules with monocycloparaffinic functionality to molecules with multicycloparaffinic functionality greater than 20. The fractions will typically have a viscosity index greater than an amount calculated by the equation: VI=28×Ln(Kinematic Viscosity at 100° C.)+95 and a pour point less than zero degrees C. Preferably the pour point will be less than −10 degrees C. "Ln" in the VI equation refers to the natural logarithm to the base 'e'. Viscosity index is determined by ASTM D 2270-93(1998).

Optionally, the lubricating base oil produced by hydroisomerization dewaxing may be hydrofinished. The hydrofinishing may occur in one or more steps, either before or after fractionating of the lubricating base oil into one or more fractions. The hydrofinishing is intended to improve the oxidation stability, UV stability, and appearance of the product by removing aromatics, olefins, color bodies, and solvents. A general description of hydrofinishing may be found in U.S. Pat. Nos. 3,852,207 and 4,673,487, incorporated herein. The hydrofinishing step may be needed to reduce the weight percent olefins in the lubricating base oil to less than 10, preferably less than 5, more preferably less than 1, and most preferably less than 0.5. The hydrofinishing step may also be needed to reduce the weight percent aromatics to less than 0.3, preferably less than 0.06, more preferably less than 0.02, and most preferably less than 0.01.

In a preferred embodiment the hydroisomerizing and hydrofinishing conditions in the process of this invention are tailored to produce one or more selected fractions of lubricating base oil having greater than 10 weight percent molecules with cycloparaffinic functionality, and a ratio of molecules with monocycloparaffinic functionality to molecules with multicycloparaffinic functionality greater than 20.

The lubricating base oil fractions have greater than 50 weight percent non-cyclic isoparaffins. They have measurable quantities of unsaturated molecules measured by FIMS. Preferably they have greater than 10 weight percent molecules with cycloparaffinic functionality, more preferably greater than 20. They preferably have a ratio of weight percent molecules with monocycloparaffinic functionality to weight percent molecules with multicycloparaffinic functionality greater than 20, more preferably greater than 20, even more preferably greater than 30. The presence of predominantly cycloparaffinic molecules with monocycloparaffinic functionality in the lubricating base oil fractions provides excellent oxidation stability, low Noack volatility, as well as desired additive solubility and elastomer compatibility. The lubricating base oil fractions have a weight percent olefins less than 10, preferably less than 5, more preferably less than 1, and most preferably less than 0.5. The lubricating base oil fractions preferably have a weight percent aromatics less than 0.3, more preferably less than 0.06, and most preferably less than 0.02.

The lubricating base oils useful in this invention are distinct from polyalphaolefins in that they are made from a waxy feed. Another distinction between polyalphaolefins and the lubricating base oils useful in this invention are that polyalphaolefins do not contain hydrocarbon molecules having consecutive numbers of carbon atoms. Polyalphaolefins are tri-, tetra- or penta-oligomers of 1-alkenes. Polyalphaolefins are small aliphatic molecules with branching of long alkyl chains at 2-, 4-, 6-, etc. positions, the positions depending upon the extent of oligomerization. Unlike polyalphaolefins, the lubricating base oils useful in our invention contain hydrocarbon molecules having consecutive numbers of carbon atoms.

Molecular Composition by FIMS:

The lubricating base oils made from a waxy feed of this invention were characterized by Field Ionization Mass Spectroscopy (FIMS) into alkanes and molecules with different numbers of unsaturations. The distribution of the molecules in the oil fractions was determined by FIMS. The samples were introduced via solid probe, preferably by placing a small amount (about 0.1 mg.) of the lubricating base oil to be tested in a glass capillary tube. The capillary tube was placed at the tip of a solids probe for a mass spectrometer, and the probe was heated from about 50° C. up to 600° C. at a rate of 100° C. per minute in a mass spectrometer operating at about 10-6 torr. The mass spectrometer was scanned from m/z 40 to m/z 1000 at a rate of 5 seconds per decade.

The mass spectrometer used was a Micromass Time-of-Flight. Response factors for all compound types were assumed to be 1.0, such that weight percent was determined from area percent. The acquired mass spectra were summed to generate one "averaged" spectrum.

The lubricating base oils of this invention were characterized by FIMS into alkanes and molecules with different numbers of unsaturations. The molecules with different numbers of unsaturations may be comprised of cycloparaffins, olefins, and aromatics. If aromatics were present in significant amounts in the lubricating base oil they would predominantly be identified in the FIMS analysis as 4-unsaturations. When olefins were present in significant amounts in the lubricating base oil they would be predominantly identified in the FIMS analysis as 1-unsaturations. The total of the 1-unsaturations, 2-unsaturations, 3-unsaturations, 4-unsaturations, 5-unsaturations, and 6-unsaturations from the FIMS analysis, minus the wt % olefins by $^1$H NMR, and minus the wt % aromatics by HPLC-UV is the total weight percent of molecules with cycloparaffinic functionality in the lubricating base oils of this invention. Note that if the aromatics content was not measured, it was assumed to be less than 0.1 wt % and not included in the calculation for total weight percent of molecules with cycloparaffinic functionality.

Molecules with cycloparaffinic functionality mean any molecule that is, or contains as one or more substituents, a monocyclic or a fused multicyclic saturated hydrocarbon group. The cycloparaffinic group may be optionally substituted with one or more substituents. Representative examples include, but are not limited to, cyclopropyl, cyclobutyl, cyclopentyl, cyclohexyl, cycloheptyl, decahydronaphthalene, octahydropentalene, (pentadecan-6-yl)cyclohexane, 3,7,10-tricyclohexylpentadecane, decahydro-1-(pentadecan-6-yl) naphthalene, and the like.

Molecules with monocycloparaffinic functionality mean any molecule that is a monocyclic saturated hydrocarbon group of three to seven ring carbons or any molecule that is substituted with a single monocyclic saturated hydrocarbon group of three to seven ring carbons. The cycloparaffinic group may be optionally substituted with one or more substituents. Representative examples include, but are not limited to, cyclopropyl, cyclobutyl, cyclopentyl, cyclohexyl, cycloheptyl, (pentadecan-6-yl) cyclohexane, and the like.

Molecules with multicycloparaffinic functionality mean any molecule that is a fused multicyclic saturated hydrocarbon ring group of two or more fused rings, any molecule that is substituted with one or more fused multicyclic saturated hydrocarbon ring groups of two or more fused rings, or any molecule that is substituted with more than one monocyclic saturated hydrocarbon group of three to seven ring carbons. The fused multicyclic saturated hydrocarbon ring group preferably is of two fused rings. The cycloparaffinic group may be optionally substituted with one or more substituents. Representative examples include, but are not limited to, decahydronaphthalene, octahydropentalene, 3,7,10-tricyclohexylpentadecane, decahydro-1-(pentadecan-6-yl) naphthalene, and the like.

Wt % Olefins:

The Wt % Olefins in the lubricating base oils of this invention were determined by proton-NMR by the following steps, A-D:

A. Prepare a solution of 5-10% of the test hydrocarbon in deuterochloroform.

B. Acquire a normal proton spectrum of at least 12 ppm spectral width and accurately reference the chemical shift (ppm) axis. The instrument must have sufficient gain range to acquire a signal without overloading the receiver/ADC. When a 30 degree pulse is applied, the instrument must have a minimum signal digitization dynamic range of 65,000. Preferably the dynamic range will be 260,000 or more.

C. Measure the integral intensities between:
6.0-4.5 ppm (olefin)
2.2-1.9 ppm (allylic)
1.9-0.5 ppm (saturate)

D. Using the molecular weight of the test substance determined by ASTM D 2503, calculate:
1. The average molecular formula of the saturated hydrocarbons
2. The average molecular formula of the olefins
3. The total integral intensity (=sum of all integral intensities)
4. The integral intensity per sample hydrogen (=total integral/number of hydrogens in formula)
5. The number of olefin hydrogens (=olefin integral/integral per hydrogen)
6. The number of double bonds (=olefin hydrogen times hydrogens in olefin formula/2)
7. The wt % olefins by $^1$H NMR=100 times the number of double bonds times the number of hydrogens in a typical olefin molecule divided by the number of hydrogens in a typical test substance molecule.

The wt % olefins by $^1$H NMR calculation procedure, D, works best when the % olefins result is low, less than about 15 weight percent. The olefins must be "conventional" olefins; i.e. a distributed mixture of those olefin types having hydrogens attached to the double bond carbons such as: alpha, vinylidene, cis, trans, and trisubstituted. These olefin types will have a detectable allylic to olefin integral ratio between 1 and about 2.5. When this ratio exceeds about 3, it indicates a higher percentage of tri or tetra substituted olefins are present and that different assumptions must be made to calculate the number of double bonds in the sample.

Aromatics Measurement by HPLC-UV:

The method used to measure low levels of molecules with at least one aromatic function in the lubricating base oils of this invention employed a Hewlett Packard 1050 Series Quaternary Gradient High Performance Liquid Chromatography (HPLC) system coupled with a HP 1050 Diode-Array UV-Vis detector interfaced to an HP Chem-station. Identification of the individual aromatic classes in the highly saturated lubricating base oils was made on the basis of their UV spectral pattern and their elution time. The amino column used for this analysis differentiates aromatic molecules largely on the basis of their ring-number (or more correctly, double-bond number). Thus, the single ring aromatic containing molecules elute first, followed by the polycyclic aromatics in order of increasing double bond number per molecule. For aromatics with similar double bond character, those with only alkyl substitution on the ring elute sooner than those with naphthenic substitution.

Unequivocal identification of the various base oil aromatic hydrocarbons from their UV absorbance spectra was accomplished recognizing that their peak electronic transitions were all red-shifted relative to the pure model compound analogs to a degree dependent on the amount of alkyl and naphthenic substitution on the ring system. These bathochromic shifts are well known to be caused by alkyl-group delocalization of the electrons in the aromatic ring. Since few unsubstituted aromatic compounds boil in the lubricant range, some degree of red-shift was expected and observed for all of the principle aromatic groups identified.

Quantitation of the eluting aromatic compounds was made by integrating chromatograms made from wavelengths optimized for each general class of compounds over the appropriate retention time window for that aromatic. Retention time window limits for each aromatic class were determined by manually evaluating the individual absorbance spectra of eluting compounds at different times and assigning them to the appropriate aromatic class based on their qualitative similarity to model compound absorption spectra. With few exceptions, only five classes of aromatic compounds were observed in highly saturated API Group II and III lubricating base oils.

HPLC-UV Calibration:

HPLC-UV was used for identifying these classes of aromatic compounds even at very low levels. Multi-ring aromatics typically absorb 10 to 200 times more strongly than single-ring aromatics. Alkyl-substitution also affected absorption by about 20%. Therefore, it is important to use HPLC to separate and identify the various species of aromatics and know how efficiently they absorb.

Five classes of aromatic compounds were identified. With the exception of a small overlap between the most highly retained alkyl-1-ring aromatic naphthenes and the least highly retained alkyl naphthalenes, all of the aromatic compound classes were baseline resolved. Integration limits for the co-eluting 1-ring and 2-ring aromatics at 272 nm were made by the perpendicular drop method. Wavelength dependent response factors for each general aromatic class were first determined by constructing Beer's Law plots from pure model compound mixtures based on the nearest spectral peak absorbances to the substituted aromatic analogs.

For example, alkyl-cyclohexylbenzene molecules in lubricating base oils exhibit a distinct peak absorbance at 272 nm that corresponds to the same (forbidden) transition that unsubstituted tetralin model compounds do at 268 nm. The concentration of alkyl-1-ring aromatic naphthenes in lubricating base oil samples was calculated by assuming that its molar absorptivity response factor at 272 nm was approximately equal to tetralin's molar absorptivity at 268 nm, calculated from Beer's law plots. Weight percent concentrations of aromatics were calculated by assuming that the average molecular weight for each aromatic class was approximately equal to the average molecular weight for the whole lubricating base oil sample.

This calibration method was further improved by isolating the 1-ring aromatics directly from the lubricating base oils via exhaustive HPLC chromatography.

Calibrating directly with these aromatics eliminated the assumptions and uncertainties associated with the model compounds. As expected, the isolated aromatic sample had a lower response factor than the model compound because it was more highly substituted.

More specifically, to accurately calibrate the HPLC-UV method, the substituted benzene aromatics were separated from the bulk of the lubricating base oil using a Waters semi-preparative HPLC unit. 10 grams of sample was diluted 1:1 in n-hexane and injected onto an amino-bonded silica column, a 5 cm×22.4 mm ID guard, followed by two 25 cm×22.4 mm ID columns of 8-12 micron amino-bonded silica particles, manufactured by Rainin Instruments, Emeryville, Calif., with n-hexane as the mobile phase at a flow rate of 18 mls/min. Column eluent was fractionated based on the detector response from a dual wavelength UV detector set at 265 nm and 295 nm. Saturate fractions were collected until the 265 nm absorbance showed a change of 0.01 absorbance units, which signaled the onset of single ring aromatic elution. A single ring aromatic fraction was collected until the absorbance ratio between 265 nm and 295 nm decreased to 2.0, indicating the onset of two ring aromatic elution. Purification and separation of the single ring aromatic fraction was made by re-chromatographing the monoaromatic fraction away from the "tailing" saturates fraction which resulted from overloading the HPLC column.

This purified aromatic "standard" showed that alkyl substitution decreased the molar absorptivity response factor by about 20% relative to unsubstituted tetralin.

Confirmation of Aromatics by NMR:

The weight percent of all molecules with at least one aromatic function in the purified mono-aromatic standard was confirmed via long-duration carbon 13 NMR analysis. NMR was easier to calibrate than HPLC UV because it simply measured aromatic carbon so the response did not depend on the class of aromatics being analyzed. The NMR results were translated from % aromatic carbon to % aromatic molecules (to be consistent with HPLC-UV and D 2007) by knowing that 95-99% of the aromatics in highly saturated lubricating base oils were single-ring aromatics.

High power, long duration, and good baseline analysis were needed to accurately measure aromatics down to 0.2% aromatic molecules. More specifically, to accurately measure low levels of all molecules with at least one aromatic function by NMR, the standard D 5292-99 method was modified to give a minimum carbon sensitivity of 500:1 (by ASTM standard practice E 386). A 15-hour duration run on a 400-500 MHz NMR with a 10-12 mm Nalorac probe was used. Acorn PC integration software was used to define the shape of the baseline and consistently integrate. The carrier frequency was changed once during the run to avoid artifacts from imaging the aliphatic peak into the aromatic region. By taking spectra on either side of the carrier spectra, the resolution was improved significantly.

The lubricating oils of this invention may also comprise a bright stock in the formulation. If the bright stock is one with a viscosity index less than 120, it is preferably included in the formulation at a level less than 10 wt %. If the bright stock is one with a viscosity index greater than 120, such as an unconventional bright stock derived from Daqing crude petroleum (which has a viscosity index of about 135), it may be included in the lubricating oil at a level up to 75 wt %. One preferred formulation of lubricating oil is one with a Fischer-Tropsch derived bright stock.

In one embodiment of this invention, the lubricating oils are made with a pour point reducing blend component. The pour point reducing blend component is a type of lubricating base oil made from a waxy feed. The pour point reducing blend component is an isomerized waxy product with relatively high molecular weights and particular branching properties such that it reduces the pour point of lubricating base oil blends containing them. The pour point depressing base oil blending component may be derived from either Fischer-Tropsch or petroleum products. In one embodiment the pour point reducing blend component is an isomerized petroleum derived base oil having a boiling range above about 950 degrees F. (about 510 degrees C.) and contains at least 50 percent by weight of paraffins. Preferably the pour point depressing base oil blending component will have a boiling range above about 1050 F. (about 565 degrees C.). In a second embodiment, the pour point reducing blend component is an isomerized Fischer-Tropsch derived bottoms product having a pour point that is at least 3 degrees C. higher than the pour point of the distillate base oil it is blended with. A preferred isomerized Fischer-Tropsch derived bottoms product that serves well as a pour point reducing blend component has an average molecular weight between about 600 and about 1100 and an average degree of branching in the molecules between about 6.5 and about 10 alkyl branches per 100 carbon atoms. The pour point reducing blend components are described in detail in U.S. patent applications Ser. No. 10/704,031, filed Nov. 7, 2003, and Ser. No. 10/839,396, filed May 4, 2004, both fully incorporated herein. The lubricating oils of this invention may contain between 1 and 80 wt % of a pour point reducing base oil blend component. Preferably, they will contain no conventional pour point depressant additives. Conventional pour point depressant additives work by minimizing the formation of wax networks and thereby reduce the amount of oil bound up in the network. Examples of conventional pour point depressant additives include polyalkylmethacrylates, styrene ester polymers, alkylated naphthalenes, ethylene vinyl acetate copolymers, and polyfumarates. Treat rates of conventional pour point depressant additives are typically less than 0.5 wt %.

Energy Savings:

In preferred embodiments, the lubricating oils of this invention will reduce energy use by at least 0.5, preferably greater than at least 1%, compared to lubricating oils of the same SAE viscosity grade made with a conventional Group I or Group II base oil. The reduction in energy use may be as high as 15%. This is due to the low traction coefficients of certain base oils made from waxy feeds. The lubricating oils of this invention will reduce energy use when the lubricating base oil made from a waxy feed used in the engine oil has a traction coefficient less than an amount calculated by the equation: Traction Coefficient=0.009×Ln (Kinematic Viscosity in cSt)−0.001, wherein the Kinematic Viscosity in cSt in the equation is the kinematic viscosity in cSt during the traction coefficient measurement and it is between 2 and 50 cSt; and wherein the traction coefficient is measured at an average rolling speed of 3 meters per second, a slide to roll ratio of 40 percent, and a load of 20 Newtons. Additionally the base oil made from a waxy feed may have an EHD film thickness greater than an amount calculated by the equation: EHD film thickness in nanometers=(10.5×Kinematic Viscosity in cSt)+20, wherein the Kinematic Viscosity in cSt in the equation is the kinematic viscosity in cSt during the EHD film thickness measurement, and it is between 2 and 50 cSt; measured at an entrainment speed of 3 meters per second, a slide to roll ratio of zero percent, and a load of 20 Newtons. Lubricating base oils made from a waxy feed having these low traction coefficients and relatively thick EHD film thicknesses are taught in U.S. patent application Ser. No. 10/835,219, filed Apr. 29, 2004, and incorporated herein.

Traction data were obtained with an MTM Traction Measurement System from PCS Instruments, Ltd. The unit was configured with a polished 19 mm diameter ball (SAE AISI 52100 steel) angled at 22° to a flat 46 mm diameter polished disk (SAE AISI 52100 steel). Measurements were made at 40° C., 70° C., 100° C., and 120° C. The steel ball and disk were driven independently by two motors at an average rolling speed of 3 Meters/sec and a slide to roll ratio of 40% [defined as the difference in sliding speed between the ball and disk divided by the mean speed of the ball and disk. SRR=(Speed1−Speed2)/((Speed1+Speed2)/2)]. The load on the ball/disk was 20 Newton resulting in an estimated average contact stress of 0.546 GPa and a maximum contact stress of 0.819 GPa.

Each oil's traction coefficient data was plotted against its respective kinematic viscosity data at each test temperature (40° C., 70° C., 100° C., and 120° C). That is, an oil's 40° C. kinematic viscosity [x coordinate] was paired with its 40° C. traction data [y coordinate], etc. Since kinematic viscosity information was generally only available at 40° C. and 100° C., the 70° C. and 120° C. kinematic viscosities were estimated from the 40° C. and 100° C. data using the well known Walther Equation [Log10(Log10(vis+0.6))=a−c*Log10 (Temp, degs K)]. The Walther Equation is the most widely used equation for estimating viscosities at odd temperatures and forms the basis for the ASTM D341 viscosity-temperature charts. Results for each oil were reported on a linear fit of the log traction coefficient data versus kinematic viscosity in cSt. The traction coefficient result for each oil at 15 cSt kinematic viscosity, and other kinematic viscosities, were read off of the plots and tabulated.

EXAMPLES

Example 1

One distillate fraction (FT-6.4) and two distillate bottoms fractions (FT-14 and FT-16) of lubricating base oil made from the hydroisomerization of a Fischer-Tropsch derived waxy feed were produced in a pilot plant. The FIMS analysis was conducted on a Micromass Time-of-Flight spectrophotometer. The emitter on the Micromass Time-of-Flight was a Carbotec 5 μm emitter designed for FI operation. A constant flow of pentaflourochlorobenzene, used as lock mass, was delivered into the mass spectrometer via a thin capillary tube. The probe was heated from about 50° C. up to 600° C. at a rate of 100° C. per minute. The properties of these lubricating base oils are summarized in Table I.

TABLE I

| Properties | FT-6.4 | FT-14 | FT-16 |
|---|---|---|---|
| Viscosity at 100° C., cSt | 6.362 | 13.99 | 16.48 |
| Viscosity at 40° C., cSt | 32.23 | 91.64 | 119.0 |
| Viscosity Index | 153 | 157 | 149 |
| Wt % Aromatics | 0.059 | 0.041 | na |
| Wt % Olefins | 3.49 | 3.17 | 0.12 |
| FIMS, Wt % | | | |
| Alkanes | 68.1 | 58.5 | 61.5 |
| 1-Unsaturations | 31.2 | 40.2 | 38.1 |
| 2-Unsaturations | 0.7 | 0.8 | 0.4 |
| 3-Unsaturations | 0.0 | 0.0 | 0.0 |
| 4-Unsaturations | 0.0 | 0.0 | 0.0 |
| 5-Unsaturations | 0.0 | 0.0 | 0.0 |
| 6-Unsaturations | 0.0 | 0.0 | 0.0 |
| Total | 100.0 | 100.0 | 100.0 |
| Total Molecules with Cycloparaffinic Functionality | 28.31 | 37.83 | 38.4 |
| Monocycloparaffins/ Multicycloparaffins | 39.6 | 46.3 | 95.0 |
| Boiling Point | | | |

TABLE I-continued

| Properties | FT-6.4 | FT-14 | FT-16 |
|---|---|---|---|
| Distribution, ° F. | | | |
| T5 | 847 | 963 | na |
| T10 | 856 | 972 | |
| T20 | 869 | 990 | |
| T30 | 881 | 1006 | |
| T50 | 905 | 1045 | |
| T70 | 931 | 1090 | |
| T80 | 946 | 1122 | |
| T90 | 962 | 1168 | |
| T95 | 972 | 1203 | |
| Pour Point, ° C. | −23 | −8 | −26 |
| Traction Coefficient | | Not tested | Not tested |
| Viscosity (cSt)/Traction Coef. | 6.4/0.01138<br>12.5/0.01732<br>15/0.0197<br>32/0.02415 | | |

na = not available.

FT-6.4, FT-14, and FT-16 are all examples of the lubricating base oils useful in the natural gas engine oils of this invention. They have less than 0.06 wt % aromatics, greater than 10 wt % molecules with cycloparaffinic functionality, and a ratio of molecules with monocycloparaffinic functionality to molecules with multicycloparaffinic functionality greater than 20. Both FT-6.4 and FT-14 have viscosity indexes greater than 150. FT-6.4 has a VI greater than an amount calculated by the equation: VI=28×Ln(Kinematic Viscosity at 100° C.)+95=147. In addition, FT-14 and FT-16 are also compositions of pour point reducing base oil blend component. FT-16 is a Fischer-Tropsch derived bright stock with a viscosity index much higher than 120.

Example 2

Three different blends of natural gas engine oil (NGEO) using the FT-6.4 and/or the FT-14 base oils were blended with a lower ash DI natural gas engine oil additive package. The natural gas engine oil blends all had approximately 0.5: wt % sulfated ash and less than 350 ppm zinc and phosphorus. No viscosity index improver was included in the three different blends. The formulations of the three different blends of natural gas engine oil are summarized in Table II.

TABLE II

| Component, Wt % | NGEO A | NGEO B | NGEO C |
|---|---|---|---|
| Lower Ash DI NGEO Additive Pkg. | 8.0 | 8.0 | 8.0 |
| FT-6.4 | 13.8 | 0 | 4.6 |
| FT-14 | 78.2 | 92.0 | 87.4 |
| Total | 100.0 | 100.0 | 100.0 |

The viscometric properties of each of the three blends are shown in Table III.

TABLE III

| Properties | NGEO A | NGEO B | NGEO C |
|---|---|---|---|
| Viscosity at 100° C., cSt | 13.48 | 15.36 | 14.86 |
| CCS Viscosity at −20° C., cP | 6008 | 5401 | 7997 |

NGEO A, NGEO B, and NGEO C are examples of the natural gas engine oils of this invention. NGEO A, NGEO B, and NGEO C comprise a lubricating base oil, made from a waxy feed, having a viscosity index greater than 150. All three of these examples also comprise a lubricating base oil made from a waxy feed having less than 0.06 wt % aromatics, greater than 10 wt % molecules with cycloparaffin functionality, and a ratio of molecules with monocycloparaffinic functionality to molecules with multicycloparaffinic functionality greater than 20. Neither NGEO A, NGEO B, nor NGEO C contains any bright stock, which is highly desired. NGEO B is an especially preferred natural gas engine oil, as it is an SAE 15W-40, with a very low cold cranking simulator (CCS) viscosity at −20° C.

Example 3

An unconventional Group III bright stock derived from Daqing Crude petroleum, Daqing Bright Stock, with the properties as shown in Table IV, was blended along with one or more Fischer-Tropsch derived lubricating base oils and the same lower ash DI additive package as used in Example 2. Daqing Bright Stock is an unconventional petroleum derived bright stock as it has a kinematic viscosity at 40° C. greater than 180 cSt, and a VI greater than 120. Three different lower ash SAE 40 natural gas engine oils were blended. The formulation details of the three blends are shown in Table V, and the viscometric properties of the three blends are shown in Table VI.

TABLE IV

| | Daqing Bright Stock |
|---|---|
| Viscosity at 100° C., cSt | 21.45 |
| Viscosity at 40° C., cSt | 186.2 |
| Viscosity Index | 137 |
| Pour Point, ° C. | −21 |

TABLE V

| Component Wt % | NGEO D | NGEO E | NGEO F |
|---|---|---|---|
| Lower Ash DI NGEO Additive Pkg. | 8.00 | 8.00 | 8.00 |
| FT-6.4 | 23.52 | 23.42 | 25.63 |
| FT-14 | 54.05 | 49.53 | 43.15 |
| Daqing Bright Stock | 14.43 | 19.05 | 23.22 |
| Total | 100.0 | 100.0 | 100.0 |

TABLE VI

| Properties | NGEO D | NGEO E | NGEO F |
|---|---|---|---|
| Viscosity at 100° C., cSt | 13.24 | 13.53 | 13.51 |
| CCS Viscosity at −20° C., cP | 5831 | 6123 | 6123 |

NGEO D, NGEO E, and NGEO F are preferred examples of an embodiment of the lubricating oils of this invention, even though they contain bright stock. The bright stock has a viscosity index greater than 120. All of them meet the kinematic and CCS viscosity specifications for SAE 15W-40 engine oils All comprise a lubricating base oil, made from a waxy feed, having a viscosity index greater than 150. Additionally, the lubricating base oils made from a waxy feed used in these blends have less than 0.06 wt % aromatics, greater than 10 wt % molecules with cycloparaffin functionality, and a ratio of molecules with monocycloparaffinic functionality to molecules with multicycloparaffinic functionality greater than 20. Even though they contain unconventional petroleum derived bright stock, and no viscosity index improver, they still have very low CCS viscosities at −20° C.

Example 4

A blend of natural gas engine oil having a SAE 15W-40 viscosity grade is prepared by mixing FT-6.4 and FT-16, with the same lower ash DI additive package used in the earlier examples. The blend contains no viscosity index improver or conventional pour point depressant additive. The natural gas engine oil is tested for kinematic viscosity at 100° C. and cold cranking simulator viscosity at −20° C. The formulation composition is summarized in Table VII and the test data is summarized in Table VIII.

TABLE VII

| Component, Wt % | NGEO G |
|---|---|
| Lower Ash DI NGEO Additive Pkg. | 8.0 |
| FT-6.4 | 27.60 |
| FT-16 | 64.40 |
| Total | 100.0 |

TABLE VIII

| Properties | NGEO G |
|---|---|
| Viscosity at 100° C., cSt | 13.4 |
| CCS Viscosity at −20° C., cP | 5616 |

This example of natural gas engine oil has a lower CCS viscosity than the blends in the earlier examples with Daqing Bright Stock. This is due to the combination of two different desirable lubricating base oils, one of which is a Fischer-Tropsch derived bright stock with a viscosity index greater than 120 (FT-16), and the other (FT-6.4) is a lubricating base oil, made from a waxy feed, having a viscosity index greater than 150, and also having a preferred aromatic and cycloparaffin composition.

What is claimed is:

1. A lubricating oil, comprising:

a. at least 5 wt % of a lubricating base oil, made from a waxy feed, having:

i. greater than 10 wt % molecules with cycloparaffinic functionality, ii. a ratio of molecules with monocycloparaffinic functionality to molecules with multicycloparaffinic functionality greater than 20, and iii. a viscosity index greater than an amount calculated by the equation: VI=28×Ln(Kinematic Viscosity at 100° C.)+95; and b. a lower ash DI additive package;

wherein the lubricating oil contains less than 0.2 wt % viscosity index improver which is a homo- or co-polymer or derivative thereof of number average molecular weight of about 15000 to 1 million atomic mass units; and wherein the lubricating oil has a sulfated ash by ASTM D 874-00 of 1.0 weight percent or less, and a cold cranking simulator viscosity at −20° C. less than 9000 cP.

2. The lubricating oil of claim 1 wherein the lubricating oil has a sulfated ask by ASTM D 874-00 of 0.15 weight percent or less.

3. The lubricating oil of claim 1, wherein the cold cranking simulator viscosity at −20° C. is less than 7000 cP.

4. The lubricating oil of claim 1, wherein the lubricating base oil has less than 0.06 wt % aromatics.

5. The lubricating oil of claim 1, having no conventional petroleum derived bright stock.

6. The lubricating oil of claim 1, having a kinematic viscosity at 100° C. between 12.5 and 16.3 cSt.

7. The lubricating oil of claim 6, wherein the lubricating oil is a SAE 15W-40 viscosity grade.

8. The lubricating oil of claim 1, wherein the lubricating base oil is a pour point reducing base oil blend component selected from the group of an isomerized petroleum derived base oil having a boiling range above about 510 degrees C. and an isomerized Fischer-Tropsch derived product having an average molecular weight between about 600 and about 1100.

9. The lubricating oil of claim 1, wherein the waxy feed is Fischer-Tropsch derived.

10. The lubricating oil of claim 1, additionally comprising a pour point reducing base oil blend component selected from the group of an isomerized petroleum derived base oil having a boiling range above about 510 degrees C. and an isomerized Fischer-Tropsch derived product having an average molecular weight between about 600 and about 1100.

11. The lubricating oil of claim 1, wherein the lubricating oil reduces energy use by at least 1% compared to a lubricating oil of the same viscosity grade made with a conventional Group I or Group II base oil.

12. A lubricating oil, comprising:

a. between 5 and 95 wt % of a lubricating base oil made from a waxy feed, wherein the lubricating base oil made from a waxy feed has a viscosity index greater than 150;

i. greater than 10 wt % molecules with cycloparaffinic functionality, ii. A ratio of molecules with monocycloparaffinic functionality to molecules with multicycloparaffinic functionality greater than 20, and iii. a viscosity index greater than an amount calculated by the equation: VI=28×Ln(Kinematic Viscosity at 100° C.)+95;

b. greater than zero up to 23.22 wt % of an unconventional petroleum derived bright stock having a viscosity index greater than 120;

c. between 5 and 12 wt % of a lower ash DI additive package; and d. less than 0.2 wt % of a viscosity index improver which is a homo- or co-polymer or derivative thereof of number average molecular weight of about 15000 to 1 million atomic mass units;

wherein the lubricating oil has a kinematic viscosity at 100° C. between 12.5 and 16.3 cSt and a cold cranking simulator viscosity at −20° C. less than 8000 cP.

13. The lubricating oil of claim 12, wherein the lubricating base oil made from a waxy feed is Fischer-Tropsch derived.

14. The lubricating oil of claim 12, wherein the lubricating base oil made from a waxy feed has less than 0.06 wt % aromatics.

15. The lubricating oil of claim 12, wherein the lubricating base oil made from a waxy feed has greater than 10 wt % molecules with cycloparaffinic functionality and a ratio of molecules with monocycloparaffinic functionality to molecules with multicycloparaffinic functionality greater than 20.

16. The lubricating oil of claim 12, wherein the lubricating base oil made from a waxy feed is a blend of two or more lubricating base oils having different kinematic viscosities at 100 degrees C.

17. A process to make a lubricating oil, comprising:

a. selecting a lubricating base oil, made from a waxy feed, having:

i. greater than 10 wt % molecules with cycloparaffinic functionality, ii. a ratio of molecules with monocycloparaffinic functionality to molecules with multicycloparaffinic functionality greater than 20; and b. blending the lubricating base oil with;

i. a lower ash DI additive package; and ii. less than 0.2 wt % viscosity index improver which is a homo- or co-polymer or derivative thereof of number average molecular weight or about 15000 to 1 million atomic mass units;

wherein the lubricating oil has a sulfated ash by ASTM D 874-00 of 1.0 weight percent or less and a cold cranking simulator viscosity at −20° C. less than 9000 cP; and wherein the lubricating base oil has a viscosity index greater than an amount calculated by the equation: VI=28×Ln(Kinematic Viscosity at 100° C.)+95.

18. The process of claim 17, wherein the lubricating oil has a sulfated ash by ASTM D 874-00 of 0.15 weight percent or less.

19. The process of claim 17, wherein the lubricating base oil has less than 0.06 wt % aromatics.

20. The process of claim 17, including the additional step of adding an unconventional petroleum derived or a Fischer-Tropsch derived bright stock having a viscosity index greater than 120 to the lubricating base oil.

21. The process of claim 17, wherein the lubricating oil has a cold cranking simulator viscosity at −20° C. less than 7000 cP.

22. The lubricating oil of claim 1, additionally comprising from greater than zero up to 23.22 wt % of an unconventional petroleum derived bright stock having a viscosity index greater than 120.

23. The lubricating oil of 12, comprising from 14.43 up to 23.22 wt % of the unconventional petroleum derived bright stock.

24. The lubricating oil of claim 22, comprising from 14.43 up to 23.22 wt % of the unconventional petroleum derived bright stock.

25. The process or claim 17, including the additional step of adding from greater than zero up to 75 wt % of an unconventional petroleum derived bright stock having a viscosity index greater than 120.

26. The process of claim 25, including adding from 14.43 up to 75 wt % of the unconventional petroleum derived bright stock.

* * * * *